US006962504B2

(12) United States Patent
Fukui et al.

(10) Patent No.: US 6,962,504 B2
(45) Date of Patent: Nov. 8, 2005

(54) PROTECTING DEVICE FOR CONNECTOR AND CONNECTOR ASSEMBLY WITH THE SAME

(75) Inventors: Masayuki Fukui, Shizuoka (JP); Kenichi Ikeya, Shizuoka (JP); Tomoki Kajii, Kanagawa (JP); Ryo Sawada, Kanagawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/807,314

(22) Filed: Mar. 24, 2004

(65) Prior Publication Data

US 2005/0003699 A1 Jan. 6, 2005

(30) Foreign Application Priority Data

Mar. 24, 2003 (JP) ..... P2003-081152

(51) Int. Cl.[7] ..... H01R 13/58
(52) U.S. Cl. ..... 439/466; 439/473
(58) Field of Search ..... 439/450–457, 439/460, 463, 466–468, 473

(56) References Cited

U.S. PATENT DOCUMENTS 5,688,144 A * 11/1997 Kosuge ..... 439/596
6,171,136 B1 * 1/2001 Liu et al. ..... 439/466
6,814,581 B2 * 11/2004 Matsuo et al. ..... 439/35
6,824,420 B2 * 11/2004 Ushiro et al. ..... 439/455

FOREIGN PATENT DOCUMENTS

JP 10-154545 6/1998

* cited by examiner

*Primary Examiner*—Khiem Nguyen
(74) *Attorney, Agent, or Firm*—Finnegan, Henderson, Farabow, Garrett & Dunner, L.L.P.

(57) ABSTRACT

The protecting device has a wire passage for wiring the wires led out of the connector. The wire passage includes a first passage part for wiring the wires along a first wiring direction to lead the wires to terminal out of the connector, a second passage part for wiring the wires in a second wiring direction different from the first wiring direction and a third passage part for wiring the wires in a third wiring direction different from the second wiring direction. The third passage part extends in a direction in which the wires are led out of the connector. The protecting device farther has a wire-interference rib formed at a boundary between the second passage part and the third passage part to project in an opposite direction to the direction in which the wires are led out of the connector.

11 Claims, 9 Drawing Sheets

PROTECTING DEVICE FOR CONNECTOR AND CONNECTOR ASSEMBLY WITH THE SAME

BACKGROUND OF THE INVENTION

The present invention relates to a protecting device for protecting a connector and electrical wires led out of the connector and also relates to a connector assembly having the protecting device and the connector.

FIGS. 1 to 3 show a conventional protecting device for a connector, which is disclosed in Japanese Patent Application Laid-open No. 10-154545.

As shown in these figures, a connector 100 includes a connector housing 101 as an object to be protected by the protecting device. The connector housing 101 is provided with a plurality of cavities 102. Inserted into the cavities 102 are a plurality of terminals 103 that are connected to respective ends of wires W. In assembling, the terminals 103 are inserted into the cavities 102 from the backside of the connector 100. Each wire W is equipped, on the periphery of an end portion thereof, with a waterproof rubber 104. In assembling, the waterproof rubber 104 is fitted to the vicinity of a rear opening of the cavity 102, effecting a watertight function therein.

As the protecting device, a protecting member 105 is connected to the rear end of the connector housing 101 through hinges 106. This protecting member 105 is in the form of a flat plate, having an elastic projection 107 formed at the opposite end to the hinges 106. When pivoting the protecting member 105 from its opened state (see FIGS. 1 and 2) to the closed state (see FIG. 3), the elastic projection 107 is engaged with an engagement claw 108 on the side of the connector housing 101. As shown in FIG. 3, the protecting member 105 in the closed state is positioned apart from the rear face of the connector housing 101 at a predetermined interval L while opposing to the housing 101. The wires W extending from the rear side of the connector housing 101 are bent to a direction generally-perpendicular to a leading direction A, at a gap between the housing 101 and the protecting member 105 and further extracted from a lateral gap therebetween, In this way, this protecting member 105 covers the rear side of the wires W extracted from the rear face of the connector 100.

In the so-constructed protecting member 105, there exists a problem that if a tensile force f shown in FIGS. 2 and 3 is applied on the wire(s) W, then the force f exerts a bad influence to the connector 100 due to its direct action thereon.

Additionally, since the application of the tensile force f on the wire W causes the wires W to be pulled in an oblique (generally-perpendicular) direction to the leading direction A to lead them from the connector 100, the waterproof rubber 104 is deformed elastically due to the tensile force f, so that a clearance is produced in the cavity 102 thereby deteriorating the water proofing property of the connector 100.

SUMMARY OF THE INVENTION

Under the circumstances, it is therefore an object of the present invention to provide a protecting device for a connector that can restrict a tensile force to the wires from acting on over to a connector thereby preventing the connector from being damaged due to the tensile force and also provide a connector assembly having the protecting device and the connector.

Another object of the present invention is to provide a protecting device enhancing the water proofing property of the connector.

According to the first aspect of the present invention, the above objects of the present invention described above can be accomplished by a protecting device for a connector with one or more electrical wires, the protecting device comprising: a wire passage formed for wiring the electrical wires led out of the connector, the wire passage including: a first passage part for wiring the electrical wires along a first wiring direction to lead the electrical wires to terminals in the connector; a second passage part for wiring the electrical wires in a second wiring direction different from the first wiring direction of the first passage part; and a third passage part for wiring the electrical wires in a third wiring direction different from the second wiring direction of the second passage part, the third passage part extending in a direction in which the electrical wires are led out of the connector, and a wire-interference rib formed at a boundary between the second passage part and the third passage part to project in an opposite direction to the direction in which the electrical wires are led out of the connector.

In the protecting device constructed above, one or more electrical wires led out of the connector are wired in the wire passage while being bent at two positions having the boundary between the first passage part and the second passage part and the boundary between the second passage part and the third passage part. Additionally, at the boundary between the second passage part and the third passage part, the electrical wires interfere with the wire-interference rib. Therefore, when a tensile force acts on the wires, the wire-interference rib is subjected to at least part of the tensile force. En addition to such an absorbing action by the wire-interference rib, the tensile force is also absorbed since the wiring arrangement where the wires are being bent at two positions in the protecting device is changed to a direction to weaken such a deflection of the wires.

In a preferred embodiment, the third passage part is provided, on an inner surface thereof, with an uneven part.

In this case, if the connector to be assembled with the protecting device is provided with a corrugate tube allowing the wires to be inserted thereinto, then it becomes possible for the protecting device to hold the corrugate tube certainly due to the provision of the uneven part.

A bend angle between the first wiring direction of the first passage part and the second wiring direction of the second passage part and another bend angle between the second wiring direction of the second passage part and the third wiring direction of the third passage part may be substantially right angles, respectively.

The wires led out of the connector may be wired in the wire passage while being bend at two positions of the boundary between the first passage part and the second passage part and the boundary between the second passage part and the third passage part at substantially right angles, respectively.

The protecting device further may comprise a base member, a cover member and a hinge part for connecting the base member to the cover member. The first passage part and the second passage part are formed in the base member, while the third passage part is formed in both of the base member and the cover member, and the protecting device is capable of displacement between an opened state that an inside surface of the base member and an inside surface of the cover member are opened and an assembled state that a joint surface of the base member confronts a joint face of the cover member by the hinge part.

In this protecting device, if only arranging the wires in the wire passage (i.e. the first passage part and the second passage part) inside the base member while positioning the base member and the cover member in the above-mentioned opened state, the subsequent assembling of the base member and the cover member allows the wires to be wired along the wire passage.

The base member and the cover member may be provided with locking mechanisms for locking up the base member and the cover member in the assembled state, and the locking mechanisms are arranged in positions on the side of the joint surfaces far from the hinge part and also arranged in positions on the side of the joint surfaces close to the hinge part.

In this protecting device, it enables the protecting device to be locked to the connector, at not only the protecting device's part far from the hinge part but the protecting device's part near the hinge part.

According to the second aspect of the present invention, there is also provided a connector assembly comprising: a connector including a connector housing having one or more cavities formed therein, one or more electrical wires, one or more terminals connected to respective ends of the electrical wires and arranged in the cavities of the connector housing respectively, and one or more shield members each of which is interposed between each of the electrical wires and the inner surface of each of the cavities; and a protecting device to be assembled to the connector, the protecting device including a wire passage formed for wiring the electrical wires led to terminals in the connector, the wire passage including a first passage part for wiring the electrical wires along a first wiring direction to lead the electrical wires out of the connector, a second passage part for wiring the electrical wires in a second wiring direction different from the first wiring direction of the first passage part, and a third passage part for wiring the electrical wires in a third wiring direction different from the second wiring direction of the second passage part, the third passage part extending in a direction in which the electrical wires are led out of the connector; and a wire-interference rib formed at a boundary between the second passage part and the third passage part to project in an opposite direction to the direction in which the electrical wires are led out of the connector.

In the above-mentioned connector assembly as well, the similar operation and effects in accordance with the protecting device of the first aspect are realized. Further, even if a tensile force acts on portions of the wires wired in the first passage part as a result that the so-weakened tensile force has been transmitted to the connector, the wires in the first passage part are not led out of the connector obliquely to the wire-leading direction but only in a generally-identical direction to the direction. Consequently, there is no possibility that the shield members are elastically deformed to produce clearances in the cavities of the connector.

In the above connector assembly, the connector further may include a corrugate tube arranged apart from the connector housing to allow the electrical wires to be inserted.

In the above connector assembly, the third passage part of the protecting device may be provided with an uneven part for engagement with the outer periphery of the corrugate tube.

Then, owing to the provision of the uneven part, the protecting device is capable of retaining the corrugate tube certainly.

In the above connector assembly, a bend angle between the first wiring direction of the first passage part and the second wiring direction of the second passage part and another bend angle between the second wiring direction of the second passage part and the third wiring direction of the third passage part are substantially right angles, respectively.

In the above-mentioned connector assembly as well, the similar operation and effects in accordance with the protecting device described above are realized.

In the above connector assembly, the protecting device may be formed by a base member, a cover member and a hinge part for connecting the base member to the cover member, and the protecting device is capable of displacement between an opened state that an inside surface of the base member and an inside surface of the cover member are opened and an assembled state that a joint surface of the base member confronts a joint face of the cover member by the hinge part.

In the above-mentioned connector assembly as well, the similar operation and effects in accordance with the protecting device described above are realized.

In the above connector assembly, the base member and the cover member are provided with locking mechanisms for locking up the base member and the cover member in the assembled state, and the locking mechanisms are arranged in positions on the side of the joint surfaces far from the hinge part and also arranged in positions on the side of the joint surfaces close to the hinge part.

In the above-mentioned connector assembly as well, the similar operation and effects in accordance with the protecting device described above are realized.

These and other objects and features of the present invention will become more fully apparent from the following description and appended claims taken in conjunction with the accompany drawings.

DESCRIPTION OF THE PREFERRED EMBODIMENT

An embodiment of the present invention will be described with reference to the drawings.

FIGS. 4 to 9 show a protecting device for a connector in accordance with an embodiment of the present invention.

Figure 1:
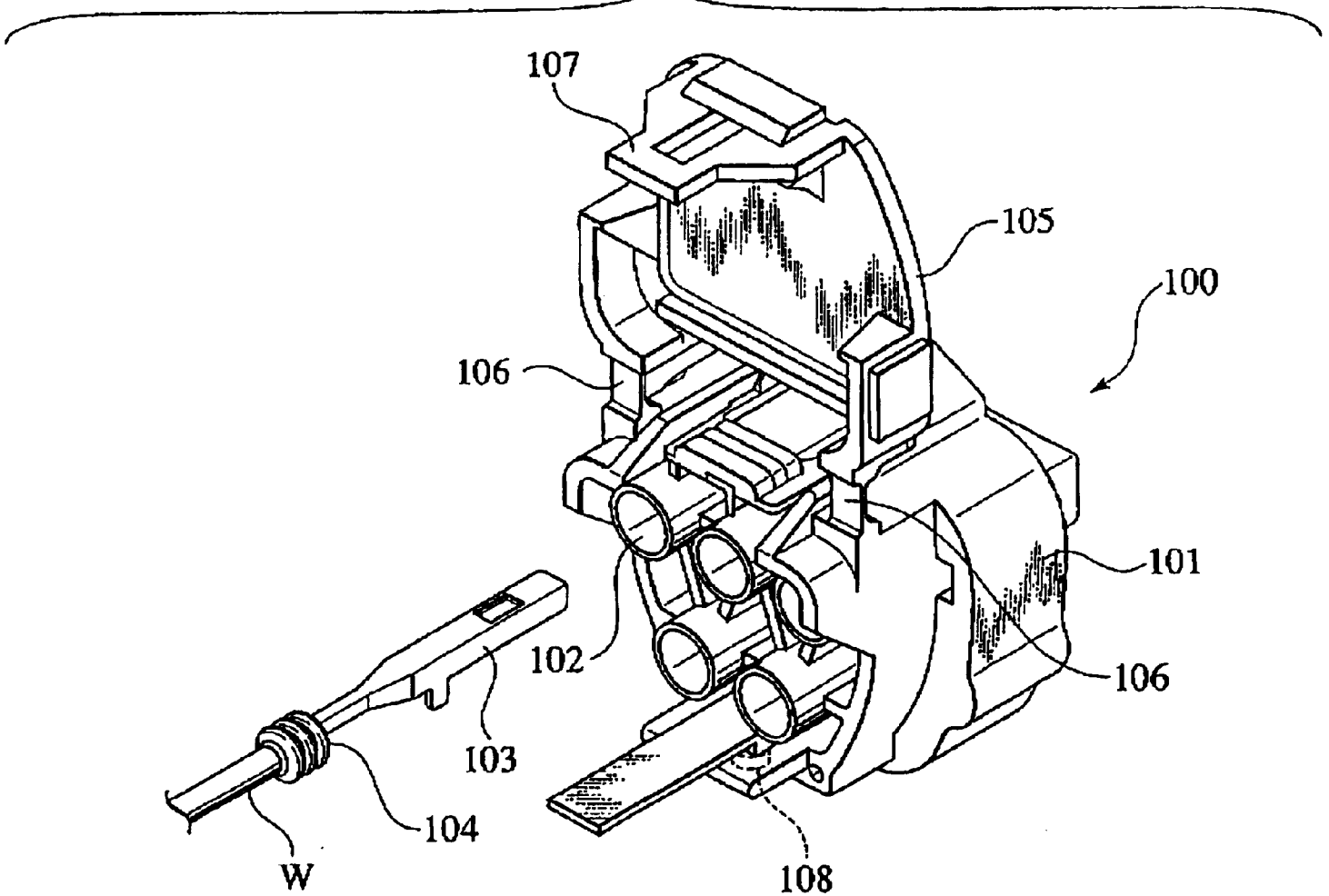
FIG.1 PRIOR ART
FIG. 1 is a perspective view of an earlier art connector equipped with a protecting member, showing a condition to fit a terminal of an electrical wire to a connector housing.
Figure 2:
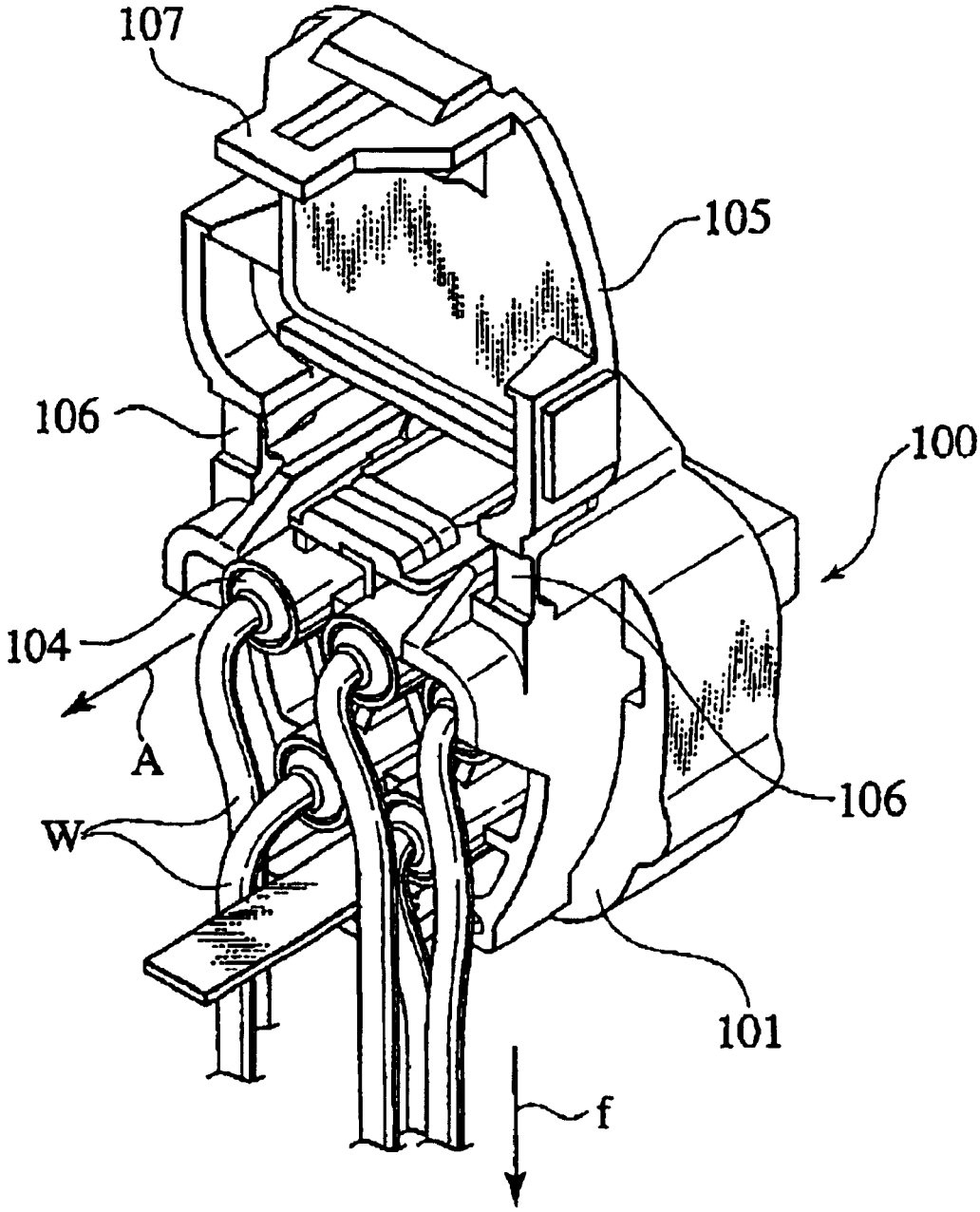
FIG.2 PRIOR ART
FIG. 2 is a perspective view of the connector of FIG. 1, showing a condition that an engagement of the terminal with the connector housing is completed.
Figure 3:
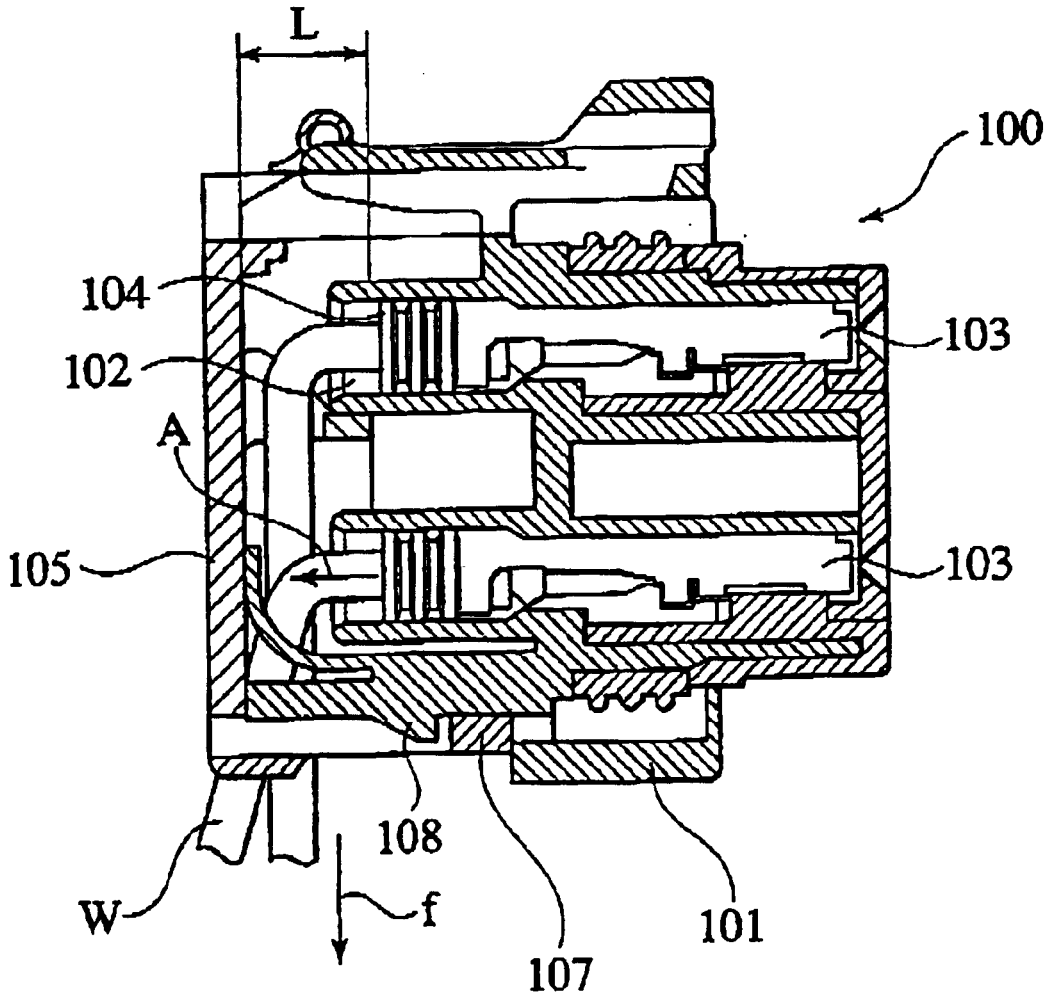
FIG.3 PRIOR ART
FIG. 3 is a sectional view of the connector and the protecting member of FIG. 1.
Figure 4:
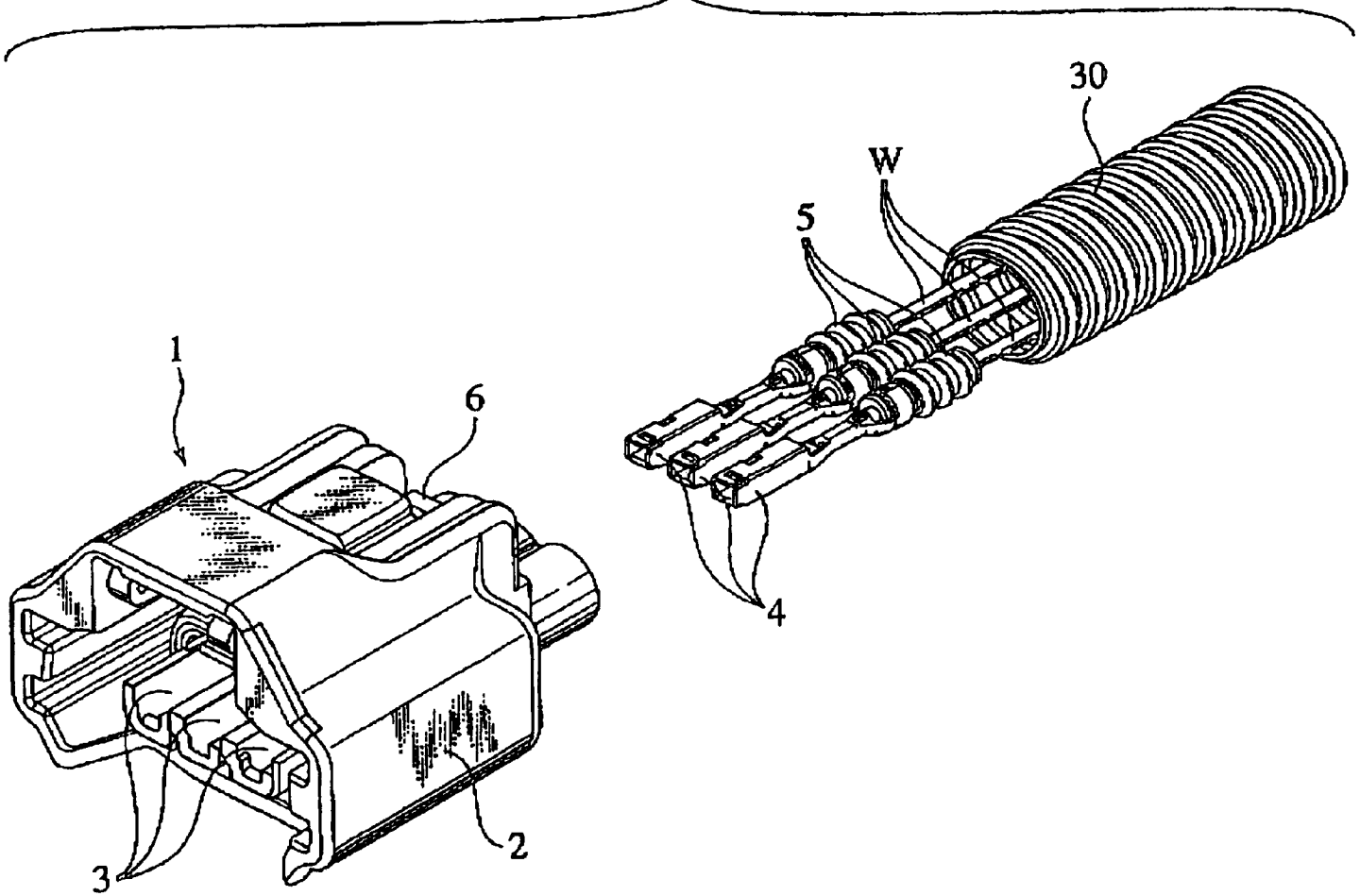
FIG. 4 is a perspective view of a connector in accordance with the embodiment of the present invention, showing a condition before fitting terminals at respective ends of wires to the connector.
Figure 5:
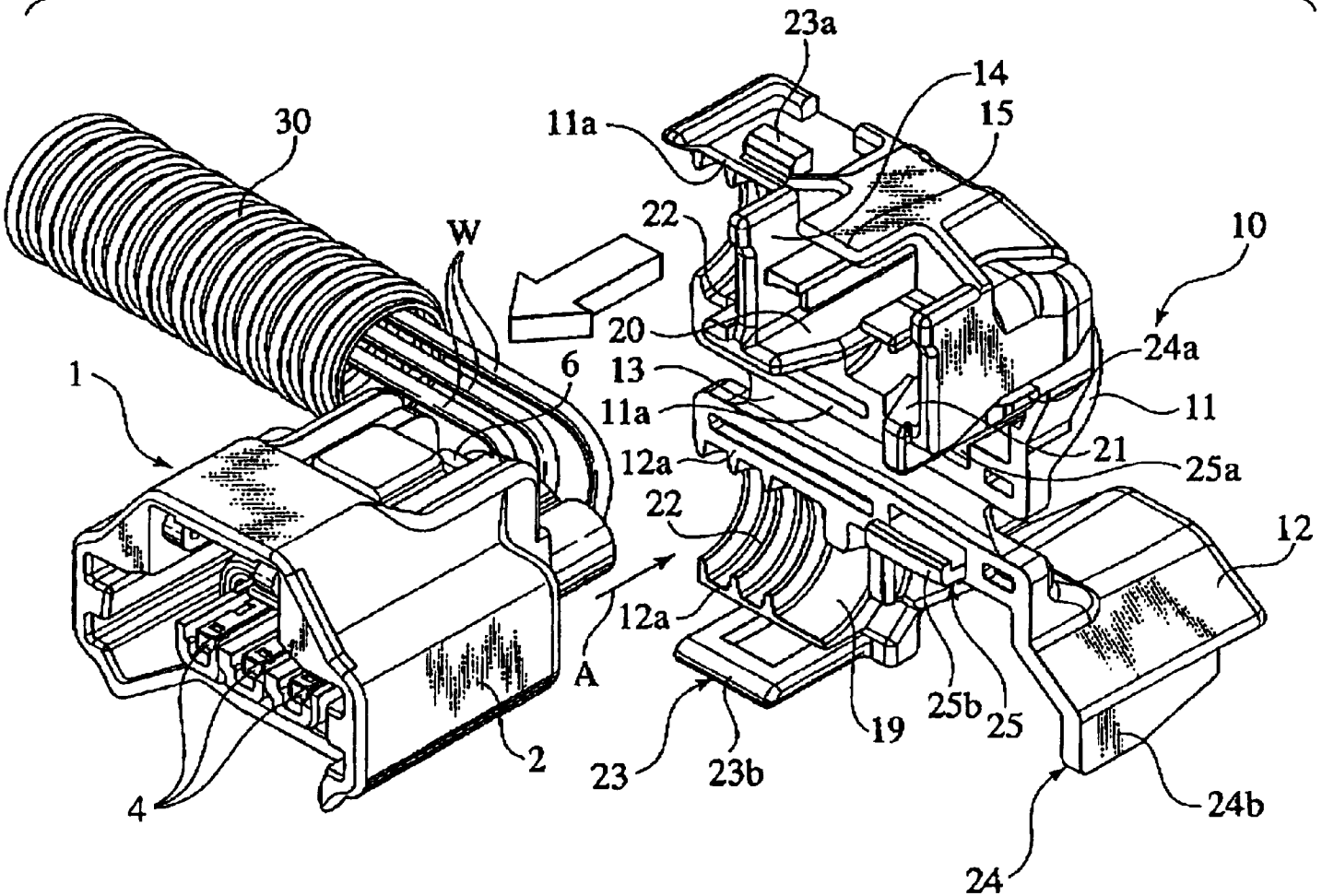
FIG. 5 is a perspective view of the connector of FIG. 4 and a protecting device of the embodiment of the invention, showing a condition before fitting the protecting device to the connector.
Figure 6:
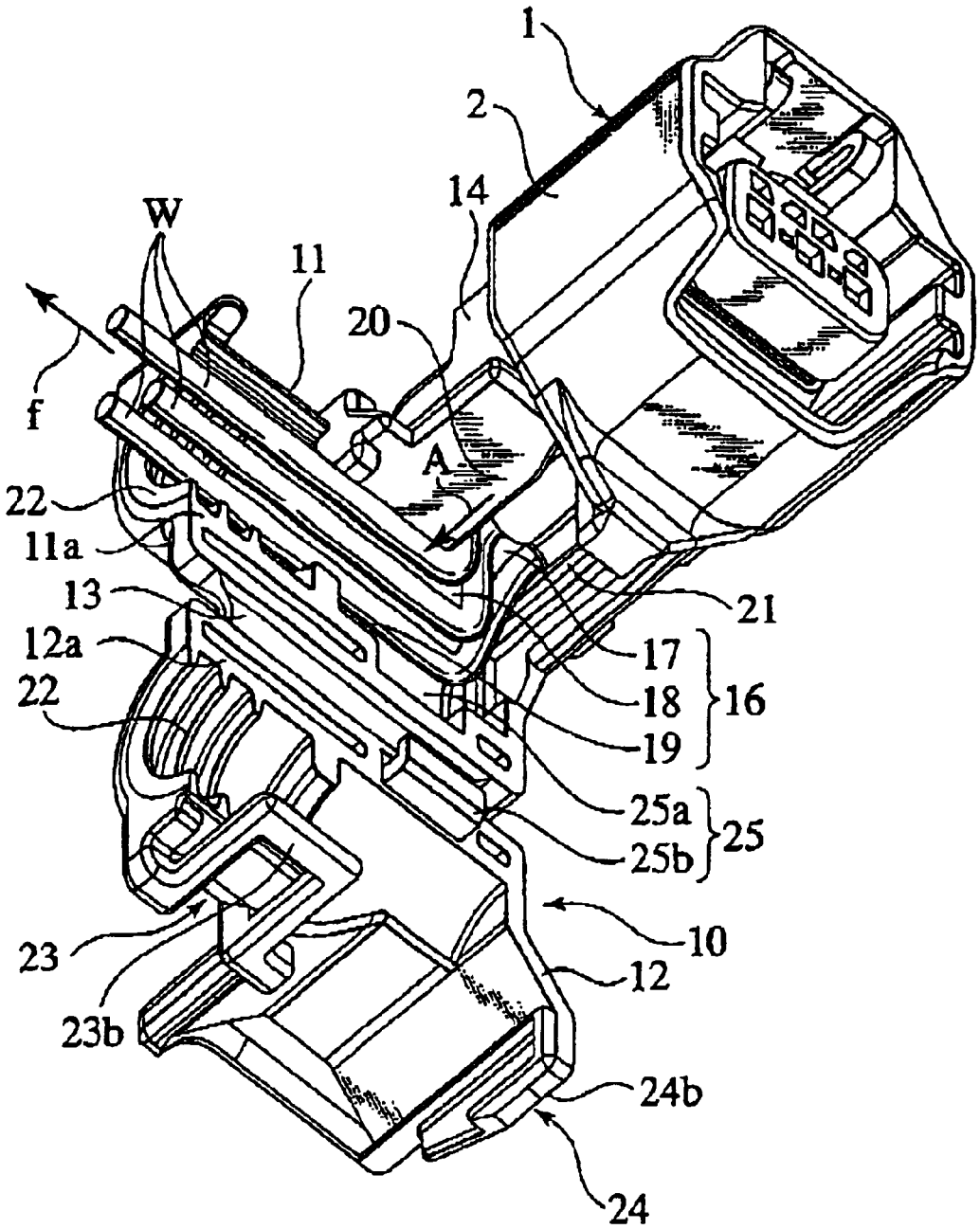
FIG. 6 is a perspective view of the connector and the protecting device of FIG. 5 in engagement, showing a condition that the protecting device is fitted to the connector while arranging the wires in predetermined positions in a base member forming the protecting device.
Figure 7:
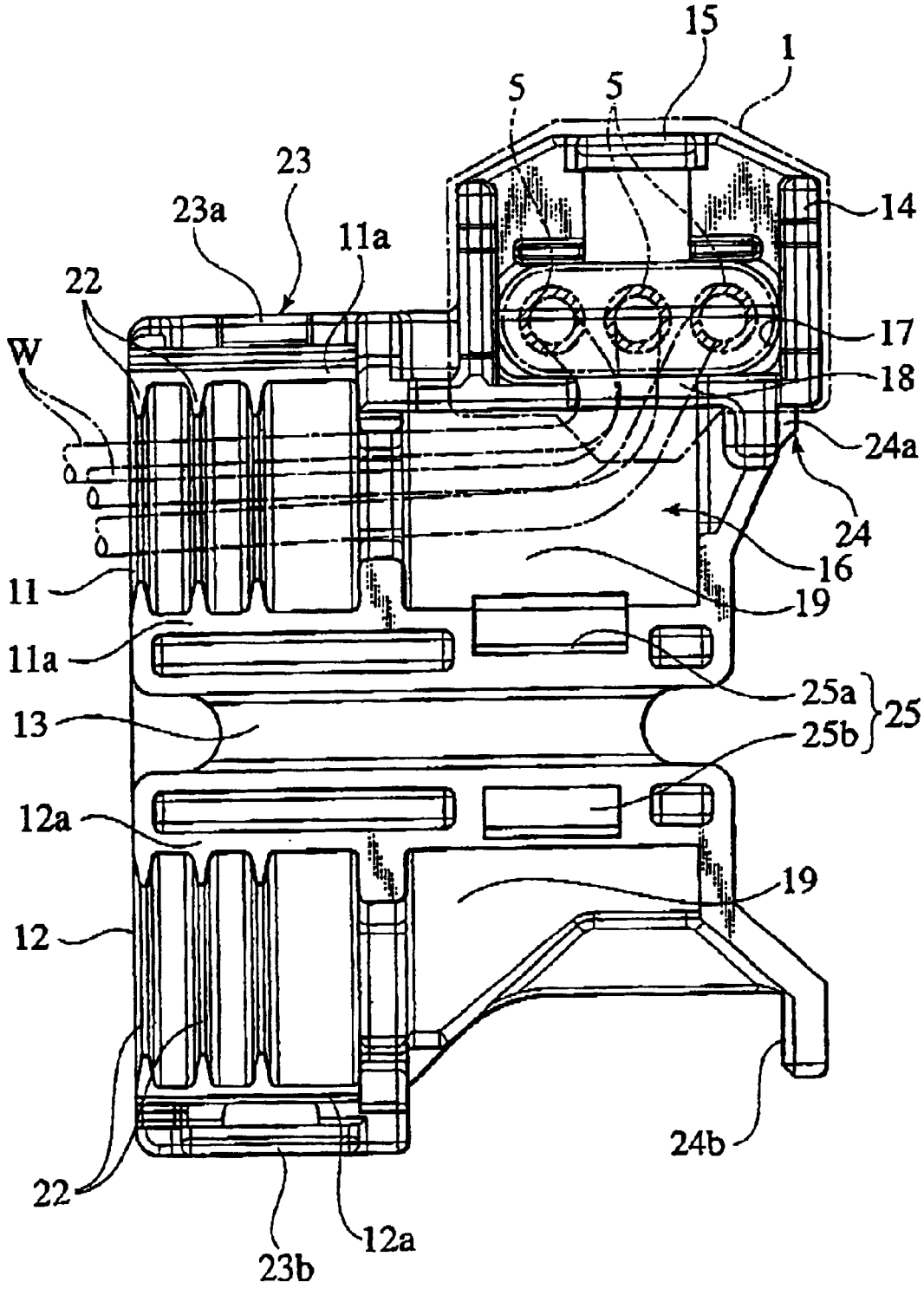
FIG. 7 is a plan view of FIG. 6.

As shown in FIGS. 4 and 5, a connector 1 is used in a location easy to soak in water, such as underside of an automotive engine. In connector 1, a connector housing 2 is provided with a plurality of cavities 3 into which terminals 4 are inserted. The terminals 4 are connected to respective ends of electrical wires W. The terminals 4 are fitted to the connector housing 2 from its backside. In the outer circumference of the gathered wires W, a cylindrical waterproof rubber 5 as a shield member is arranged so as to surround the end portions of the wires W. This waterproof rubber 5 is fitted to the vicinities of respective rear inlets of the cavities 3. The waterproof rubber 5 serves to block an entering of water through the backsides of the cavities 3. Further, the connector housing 2 is provided, on its rear side, with an engagement claw 6 for engagement with a protecting device 10.

As shown in FIGS. 5 to 9, the protecting device 10 is formed by a base member 11, a cover member 12 and a hinge part 13 for connecting these members 11 and 12 with each other. Due to deflection of the hinge member 13, both of the base member 11 and the cover member 12 are capable of displacement between their opened state to open their insides (see FIG. 5) and the closed state to confront their joint surfaces 11*a*, 12*a* with each other.

The base member 11 has a connector fitting part 14 for the connector 1. The connector 1 is engaged with the connector fitting part 14 while allowing the rear side of the connector housing 2 to be inserted into the connector fitting part 14. The connector fitting part 14 has a shape to cover the outside of the rear surface of the connector housing 2 in engagement and is provided with an elastic projection 15 that engages with the engagement claw 6 of the connector housing 2 in engagement.

Additionally, the protecting member 10 has a wire passage 16 formed for wiring the wires W led out of the rear surface of the connector housing 2. The wire passage 16 comprises a first passage part 17 formed in the base member 11 to wire the wires W below the connector fitting part 14 and along a wire-leading direction A (as the first wiring direction) to lead the wires W from the connector 1, a second passage part 18 formed in the base member 11 to wire the wires W in a direction (as the second wiring direction) substantially perpendicular to the first passage part 17 and a third passage part 19 formed in the base member 11 and the cover member 12 to wire the wires W in a direction (as the third wiring direction) substantially perpendicular to the second passage part 18. Thus, the wires W led out of the connector 1 are arranged in the wire passage 16 while being bent in two positions having a boundary between the first passage pat 17 and the second passage part 18 and another boundary between the second passage part 18 and the third passage part 19, at substantially right angles.

In the boundary between the second passage part 18 of the base member 11 and the third passage part 19 and also at its inside corner, a wire-interference rib 20 is formed to project in the opposite direction to the direction in which the wires are led out of the connector 1 in the third passage part 19. In other words, the wire-interference rib 20 projects in the direction opposite to the tensile force f direction. In the boundary between the second passage part 18 of the base member 11 and the third passage part 19 and also at its outside corner, a supplementary rib 21 is formed to project in a direction that the third passage part 19 does extend. Accordingly, the boundary between the second passage part 18 and the third passage part 19 is narrowed by the wire-interference rib 20 and the supplementary rib 21. The wires W are wired from the second passage part 18 into the third passage part 19 through the so-narrowed boundary. The wire-interference rib 20 and the supplementary rib 21 have respective lateral end surfaces opposite to each other and tapered outwardly at their upper portions, thereby facilitating the wiring of the wires W into the wire passage 16.

As mentioned above, the third passage part 19 is formed by both of the base member 11 and the cover member 12. The third passage part 19 is provided, on its inner surface on the exit side, with an uneven part 22 fitted to the peripheral shape of the corrugate tube 30. The uneven part 22 includes protrusions and recesses which are arranged alternately.

In the base member 11 and the cover member 12, locking mechanisms 23, 24 and 25 are provided to lock these members 11, 12 up in their assembled state. In the locking mechanisms 23, 24, 25 in three positions, the locking mechanisms 23, 24 are arranged in the joint surfaces (parts) 11*a*, 12*a* far from the hinge part 13 and also formed by engagement claws 23*a*, 24*a* on the side of the base member 11 and elastic projections 23*b*, 24*b* on the side of the cover member 12, respectively. The locking mechanism 25 is arranged in the joint surfaces (parts) 11*a*, 12*a* close to the hinge part 13 and also formed by an engagement hole 25*a* on the side of the base member 11 and an elastic projection 25*b* on the side of the cover member 12.

The assembling operation of the connector 1 and the assembling operation of the protecting device 10 to the so-assembled connector 1 will be described below. As shown in FIG. 4, it is firstly performed to fit the rubber members 5 to the plural wires W and also performed to connect the ends of the wires W to the terminals 4 under pressure. Next, the plural wires W having the terminals 4 connected thereto are bundled and successively, the corrugate tube 30 is arranged around the outer periphery of the bundled wires W.

Next, the terminals 4 in connection with the ends of the wires W are inserted into the cavities 3 from the base side of the connector housing 2, thereby fitting the terminals 4 to the connector housing 2. Thereafter, on installation of a retainer etc., the assembling of the connector 1 is completed.

Next, as shown in FIG. 5, it is carried out to insert the connector fitting part 14 of the protecting device 10 into the rear side of the connector housing 2. This insertion is performed while wiring the wires W led out of the connector 1 in the first passage part 17 and the second passage part 18 of the base member 11 and the third passage part 19. In detail, by bending the wires W led out of the connector 1 in two positions at general right angles, the wires W are arranged along the wire passage 16. Then, when the protecting member 10 is inserted into the connector housing 2 perfectly, the elastic projection 15 engages with the engagement claw 6, so that the protecting device 10 is locked up in the connector 1 thereby providing a connector assembly having the connector 1 and the protecting device 10.

Figure 8:
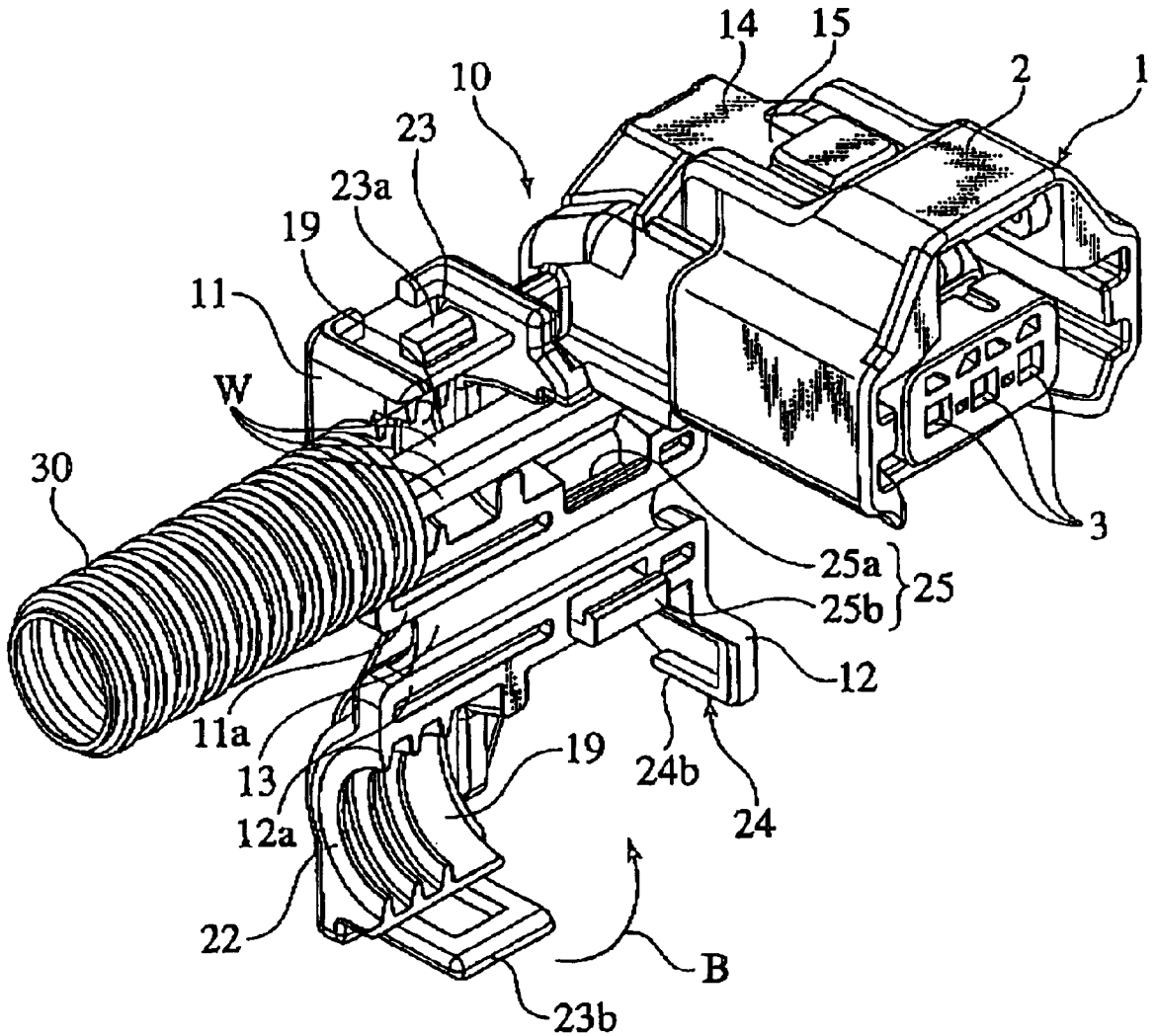
FIG. 8 is a perspective view of the connector and the protecting device of FIG. 5 in engagement, showing a condition that a corrugate tube is positioned in the base member of FIG. 5.
Figure 9:
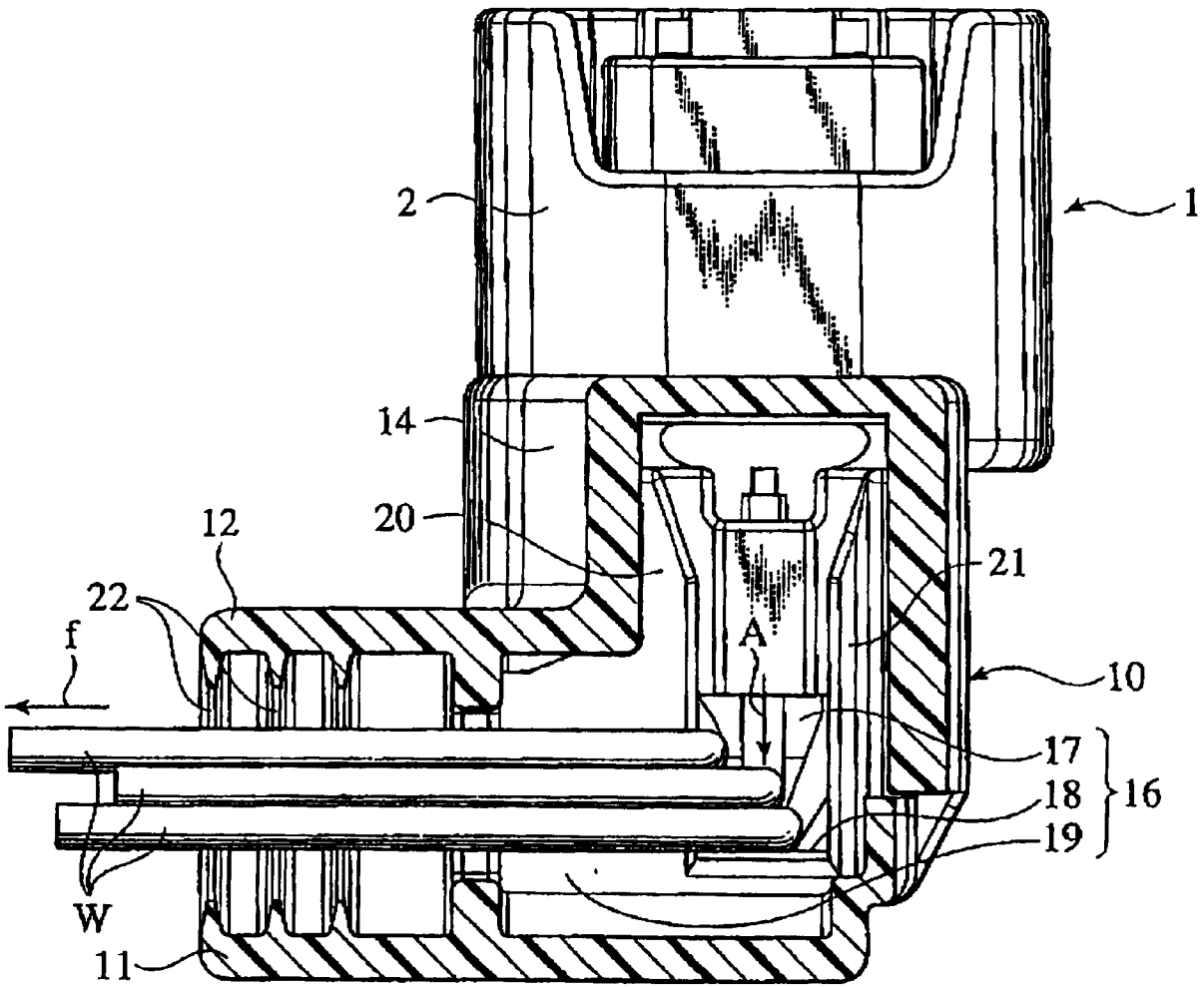
FIG. 9 is a sectional view of the protecting device of this embodiment, showing the base member and a cover member in their assembled state.

Subsequently, as shown in FIG. 8, the corrugate tube 30 is partially arranged in position of the uneven part 22 of the third passage part 19 of the base member 11.

Next, it is performed to rotate the cover member 12 in a direction B of FIG. 8 thereby bringing the member 12 and the base member 11 into their assembled condition (see FIG.

9). When the base member 11 and the cover member 12 are brought into their completely-assembled condition, there are established engagements in the locking mechanisms 23, 24 and 25, whereby the base member 11 and the cover member 12 can be locked each other. In the corrugate tube 30, its part on the side of the protecting device 10 is fitted to the uneven part 22 on both sides of the base member 11 and the cover member 12, so that the corrugate tube 30 is fitted to the protecting device 10.

In this way, the protecting device 10 and the corrugate tube 30 are engaged with the connector 1 into one body. Then, the wires W led out of the connector 1 are protected by the protecting device 10 while being wired in the corrugate tube 30.

In the protecting device 10, the wires W led out of the connector 1 are wired in the wire passage 16 while being bent at two positions having the boundary between the first passage part 17 and the second passage part 18 and the boundary between the second passage part 18 and the third passage part 19. Additionally, at the boundary between the second passage part 18 and the third passage part 19, the wires W interfere with the wire-interference rib 20. Therefore, if a tensile force f acts on the wires W (shown in FIGS. 6 and 9), the wire-interference rib 20 is subjected to at least part of the tensile force f. In addition to such an absorbing action by the wire-interference rib 20, the tensile force f is also absorbed since the wiring arrangement where the wires W are bent at two positions in the protecting device 10 is changed to a direction to weaken such a deflection of the wires W. In this way, according to the embodiment, since the tensile force f whose magnitude has been attenuated by the protecting device 10 sufficiently is transmitted to the connector 1, it becomes possible to reduce damage on the connector 1 due to the tensile force f acting on the wires W to the utmost.

Here noted, the terminals 4 at the ends of the wires W are accommodated in the cavities 3 of the connector 1 and furthermore, the rubber members 5 are interposed between the outer peripheral surfaces of the wires W and the inner surfaces of the cavities 3, respectively. Therefore, even if the tensile force f acts on portions of the wires W wired in the first passage part 17 as a result that the so-weakened tensile force has been transmitted to the connector 1, the wires W in the first passage part 17 are not led out of the connector 1 obliquely to the leading direction A but only in a generally-identical direction to the direction A. Consequently, there is no possibility that the rubber members 5 are elastically deformed to produce clearances in the cavities 3 of the connector 1, whereby high waterproofing property can be maintained in the connector 1. In other words, even if the connector 1 is arranged in such a location as being easy to soak in water, for example, the underside of an automotive engine, the water proofing property of the connector 1 can be ensured.

According to the above embodiment, since the provision of the uneven part 22 of the third passage part 19 allows the corrugate tube 30 to be connected with the protecting device 10, the wires W led out of the connector 1 can be protected by the corrugate tube 30. Additionally, as the third passage part 19 is defined by both of the base member 11 and the cover member 12 to allow the corrugate tube 30 to be fitted to the protecting device 10 at the same time of assembling, these members 11, 12, it is possible to fit the corrugate tube 30 to the protecting device 10 with ease.

Moreover, since a bend angle between the first passage part 17 and the second passage part 18 and another bend angle between the second passage part 18 and the third passage part 19 are general right angles each, the wires W led out of the connector 1 are arranged in the wire passage 16 while being bent at two positions having one boundary between the first passage part 17 and the second passage part 18 and another boundary between the second passage part 18 and the third passage part 19 at general right angles. It is noted that such an arrangement of the wires W in the connecting device 10 allows the tensile force f on the wires W to be absorbed sufficiently.

Here noted that the protecting device 10 of this embodiment is formed by the base member 11, the cover member 12 and the hinge part 13 for connecting these members 11, 12 with each other and further, due to deflection of the hinge member 13, both of the base member 11 and the cover member 12 are capable of displacement between their opened state to open their inside surfaces and the closed (or assembled) state to confront their joint surfaces 11*a*, 12*a* with each other. Therefore, if only arranging the wires W in the wire passage (part) inside the base member 11 while positioning these members 11, 12 in the above-mentioned opened state, the subsequent assembling of the members 11, 12 allows the wires W to be wired along the wire passage 16. Thus, it is possible to accomplish the wiring of the wires W with ease.

Again noted, in the base member 11 and the cover member 12, the locking mechanisms 23, 24 and 25 are provided to lock these members 11, 12 up in their assembled state. Further, since the locking mechanisms 23, 24, 25 are arranged in the joint surfaces (parts) 11*a*, 12*a* far from and close to the hinge part 13, the protecting device 10 can be locked to the connector 1 on not only a device's side far from the hinge part 13 but the device's side near the hinge part 13. Therefore, even if the hinge part 13 is broken, the assembled state between the base member 11 and the cover member 12 could be maintained in spite of the breakage.

Finally, it will be understood by those skilled in the art that the foregoing description is one preferred embodiment of the disclosed protecting device for a connector. Various changes and modifications may be made to the present invention without departing from the scope of the invention.

For example, although the protecting device 10 is provided with three locking mechanisms 23, 24 and 25 in the illustrated embodiment, both structure and number of the locking mechanisms may be altered in the modifications. Further, although the protecting device 10 of the embodiment is adapted so as to protect three wires W, the device 10 may be formed so as to protect wire(s) more or less than three wires, for example, a single wire.

What is claimed is:

1. A protecting device for a connector with one or more electrical wires, the protecting device comprising:

a wire passage formed for wiring the electrical wires led out of the connector, the wire passage including:

a first passage part for wiring the electrical wires along a first wiring direction to lead the electrical wires to terminals in the connector;

a second passage part for wiring the electrical wires in a second wiring direction different from the first wiring direction of the first passage part; and a third passage part for wiring the electrical wires in a third wiring direction different from the second wiring direction of the second passage part, the third passage part extending in a direction in which the electrical wires are led out of the connector; and a wire-interference rib formed at a boundary between the second passage part and the third passage part to project in an opposite direction to the direction in which the electrical wires are led out of the connector.

2. The protecting device as claimed in claim 1, wherein the third passage part is provided, on an inner surface thereof, with an uneven part.

3. The protecting device as claimed in claim 1, wherein a bend angle between the first wiring direction of the first passage part and the second wiring direction of the second passage part and another bend angle between the second wiring direction of the second passage part and the third wiring direction of the third passage part are substantially right angles, respectively.

4. The protecting device as claimed in claim 1, further comprising a base member, a cover member and a hinge part for connecting the base member to the cover member, wherein the first passage part and the second passage part are formed in the base member, while the third passage part is formed in both of the base member and the cover member, and the protecting device is capable of displacement between an opened state that an inside surface of the base member and an inside surface of the cover member are opened and an assembled state that a joint surface of the base member confronts a joint surface of the cover member by the hinge part.

5. The protecting device as claimed in claim 4, wherein the base member and the cover member are provided with locking mechanisms for locking up the base member and the cover member in the assembled state, and the locking mechanisms are arranged in positions on the side of the joint surfaces far from the hinge part and also arranged in positions on the side of the joint surfaces close to the hinge part.

6. A connector assembly comprising:

a connector including:

a connector housing having one or more cavities formed therein;

one or more electrical wires;

one or more terminals connected to respective ends of the electrical wires and arranged in the cavities of the connector housing, respectively; and one or more shield members each of which is interposed between each of the electrical wires and the inner surface of each of the cavities, and a protecting device to be assembled to the connector, the protecting device including:

a wire passage formed for wiring the electrical wires led out of the connector, the wire passage including a first passage part for wiring the electrical wires along a first wiring direction to lead the electrical wires to terminals in the connector, a second passage part for wiring the electrical wires in a second wiring direction different from the first wiring direction of the first passage part, and a third passage part for wiring the electrical wires in a third wiring direction different from the second wiring direction of the second passage part, the third passage part extending in a direction in which the electrical wires are led out of the connector; and a wire-interference rib formed at a boundary between the second passage part and the third passage part to project in an opposite direction to a direction in which the electrical wires are led out of the connector.

7. The connector assembly as claimed in claim 6, wherein the connector further includes a corrugate tube arranged apart from the connector housing to allow the electrical wires to be inserted.

8. The connector assembly as claimed in claim 7, wherein the third passage part of the protecting device is provided with an uneven part for engagement with the outer periphery of the corrugate tube.

9. The connector assembly as claimed in claim 6, wherein a bend angle between the first wiring direction of the first passage part and the second wiring direction of the second passage part and another bend angle between the second wiling direction of the second passage part and the third wiring direction of the third passage part are substantially right angles, respectively.

10. The connector assembly as claimed in claim 6, wherein the protecting device is formed by a base member, a cover member and a hinge part for connecting the base member to the cover member, and the protecting device is capable of displacement between an opened state that an inside surface of the base member and an inside surface of the cover member are opened and an assembled state that a joint surface of the base member confronts a joint face of the cover member by the hinge part.

11. The connector assembly as claimed in claim 10, wherein the base member and the cover member are provided with locking mechanisms for locking up the base member and the cover member in the assembled state, and the locking mechanisms are arranged in positions on the side of the joint surfaces far from the hinge part and also arranged in positions on the side of the joint surfaces close to the hinge part.

* * * * *

UNITED STATES PATENT AND TRADEMARK OFFICE

CERTIFICATE OF CORRECTION

PATENT NO. : 6,962,504 B2
DATED : November 8, 2005
INVENTOR(S) : Masayuki Fukui et al.

It is certified that error appears in the above-identified patent and that said Letters Patent is hereby corrected as shown below:

Title page,
Item [57], ABSTRACT,
Line 10, “farther” should read -- further --.

Column 10,
Line 27, “wiling” should read -- wiring --.

Signed and Sealed this

Thirty-first Day of January, 2006

JON W. DUDAS
*Director of the United States Patent and Trademark Office*